United States Patent [19]

McCoy

[11] Patent Number: 4,799,880

[45] Date of Patent: Jan. 24, 1989

[54] METHOD AND APPARATUS FOR ANALYZING PRODUCT FLOW

[76] Inventor: Charles McCoy, P.O. Box 282, 560 E. Monroe, Huntington, Oreg. 97907

[21] Appl. No.: 87,024

[22] Filed: Aug. 19, 1987

[51] Int. Cl.[4] ..... F27B 14/00

[52] U.S. Cl. ..... 432/13; 432/97; 432/99; 432/45

[58] Field of Search ..... 432/95, 98, 96, 97, 432/99, 13, 45

[56] References Cited

U.S. PATENT DOCUMENTS

| | | | |
|---|---|---|---|
| 1,521,545 | 12/1924 | Kistler . | |
| 2,726,076 | 12/1955 | Du Heaume . | |
| 2,854,714 | 10/1958 | Dietert . | |
| 3,091,443 | 5/1963 | Herz et al. . | |
| 3,133,131 | 5/1964 | Carlsen | 106/100 |
| 3,561,273 | 2/1971 | Tanila . | |
| 3,627,287 | 12/1971 | Herz | 106/100 |
| 3,751,991 | 8/1973 | Fisher et al. | 106/100 |
| 3,957,422 | 5/1976 | Kohn | 432/99 |
| 4,026,717 | 5/1977 | Harris et al. | 106/100 |

*Primary Examiner*—Henry C. Yuen

*Attorney, Agent, or Firm*—Kolisch, Hartwell & Dickinson

[57] ABSTRACT

Apparatus for analyzing the density of particulate material flowing from a kiln. The apparatus includes a sampling probe actuatable to divert a sample flow of material from material falling from a kiln. This sample flow on cascading through the apparatus is processed by screening to obtain a flow of sized material having a particle size within a predetermined range. The sized material is collected in a container which collects a measured volume of material. The material in this container is electronically weighed and recorded.

6 Claims, 1 Drawing Sheet

METHOD AND APPARATUS FOR ANALYZING PRODUCT FLOW

BACKGROUND AND SUMMARY OF THE INVENTION

Figure 1:
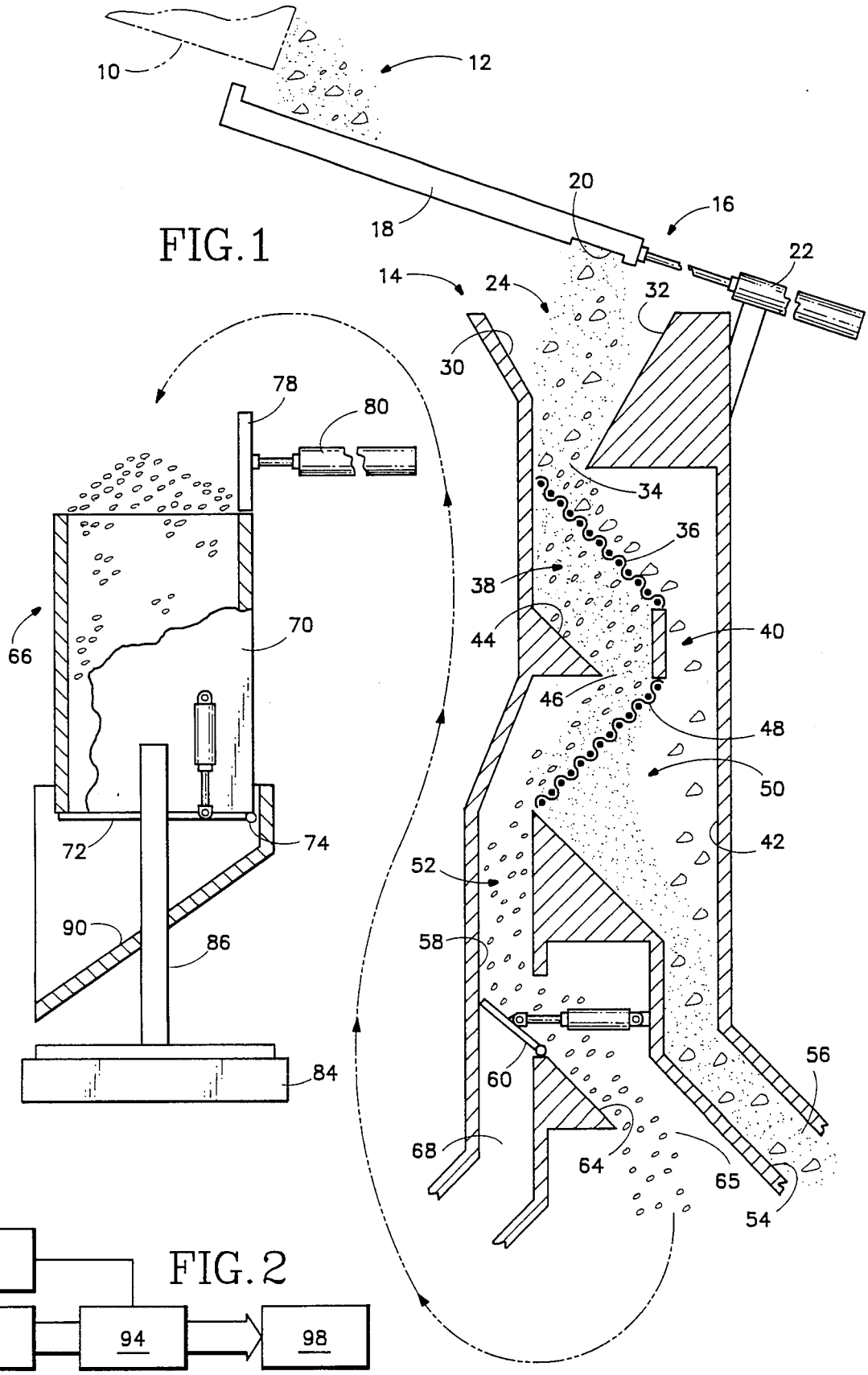

This invention relates to a method and apparatus for analyzing the product flowing from a kiln, or like instrumentality, with information obtained from the analysis being usable to automatically produce adjustments in the operating conditions of the kiln, and to perform other functions such as directing of the flow of product from the kiln to different storage facilities where different types of product are collected.

In a more specific sense, the invention is directed to a method and apparatus for controlling the degree to which a material is sintered in a rotary kiln, or similar apparatus, in order that the material being process not be either overburned or underburned. By way of example, in the production of Portland Cement clinker, the raw material from which the clinker is produced commonly is heated in a continuous rotary kiln with raw material introduced at one end and the burned clinker product flowing from the other end of the kiln. During the burning of the product in the kiln, various chemical reactions take place which have the effect of changing the porosity of the material being processed. Thus, it has been conventional in the past in controlling the operation of such a kiln to obtain a sample from the kiln and to obtain the weight of a measured volume of the sample, which is indicative of the quality of the clinker produced and also indicative of whether kiln operating conditions should be changed in order to obtain optimum properties in the clinker produced.

While it has been known in the past that density measurements of clinker material produced in a kiln are useful in controlling kiln operation and performing other functions, the usual manner of making such measurements has relied upon manual procedures for collecting and weighing a sample. Such a system has not been entirely reliable by reason of variables introduced because of different persons performing the testing. More importantly, information obtained is at relatively infrequent and nonregular intervals, meaning that it is not suitable for close control of kiln operation. Furthermore, such a procedure does not lend itself for incorporation with an automatic or semiautomatic control system for controlling kiln operation, or the directing of material from a kiln to a specific silo or storage facility, nor does it promote the continuous recording of information pertaining to operating conditions which are usable by a manufacturer in obtaining over a period of time maximum production efficiencies and the production of a uniform and quality product.

A general object of this invention, therefore, is to provide a novel means and method for monitoring the product produced in a sintering operation, such as a kiln, which on a regular and periodic basis establishes automatically data usable in controlling kiln operation.

A related object is to provide such a means and method which is highly reliable and consistent.

Yet a further object of the invention is to provide means and method for monitoring product produced by a kiln which relies upon the diversion from the output of a kiln of a sample flow of material and the processing of this sample and while flowing as induced by gravity to produce a measured volume of material having a particle size within a predetermined range which is electronically weighed, with weight and time information then recorded.

The material which is diverted to form the sample flow of material after processing to obtain the information desired is returned to the kiln operator's transport system, then to be directed by the system to an appropriate storage site such as a silo.

Following the invention and when used with a kiln producing clinker material, a record may be maintained of clinker densities at regular time intervals. The production of a consistent product is enhanced by the continuous feeding of density and timing information to the control center for the kiln. Manpower costs incurred in weighing and recording selected samples are eliminated; production costs may be reduced. Mill performance is improved by and through the maintenance of records indicating product type in any storage facility or silo involved.

Figure 2:
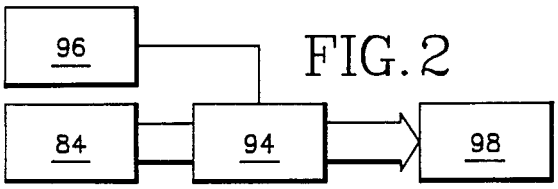

These and other objects and advantages are attained by the invention, which is described herein below in conjunction with the accompanying drawings, wherein:

FIG. 1 is a view illustrating schematically, and in somewhat simplified form, analyzing apparatus constructed according to one embodiment of the invention; and FIG. 2 is a block diagram illustrating how weight and timing information may be recorded and utilized in regulating the operating conditions of the kiln.

Referring now to the drawings, the apparatus contemplated is usable in controlling the operating conditions of a rotary kiln usable, by way of example, in the production of Portland Cement clinker from Portland Cement raw material mixes. In the usual rotary kiln, the raw material is introduced adjacent one end of the kiln. The kiln is somewhat inclined and rotates and has a heated interior and with rotation of the kiln, the material is cascaded downwardly therein while subjected to the temperature within the kiln. Sintered product, i.e., processed cement clinker, exits in a continuous flow from the lower end of the kiln. In FIG. 1, portions of such a kiln have been indicated diagramatically and in dot dashed outline at 10. Clinker falling from the kiln in gravity flow is indicated at 12.

The analyzing apparatus or testing unit of the invention, generally shown at 14, is operable to extract from the flow of clinker 12 a sample flow of clinker material which thence flows through the apparatus under the influence of gravity and which operates on material flowing through the apparatus to screen the material to produce a screened flow of predetermined particle size, this screened flow then being collected to produce a measured volume of material which is weighed electronically with this weight information and the time of weighing sent to a programmable logic controller.

Referring to FIG. 1, diversion of a sample flow of material from flow of clinkers 12 is produced through operation of a so-called sampling probe in apparatus 14, indicated at 16. The sampling probe may take the form of an elongate hollow probe element 18, which is open along the topside thereof and disposed in an inclined position so that material falling onto the probe element is captured thereby and then moves by gravity downwardly along the inclination of the probe element. The lower end of the probe element, which is toward the right in FIG. 1, is open at the bottom at 20, with material travelling down the probe element thus flowing through this opening to cascade downwardly.

The sampling probe further includes power-operated means, such as the air cylinder shown at 22, connected through its rod to element 18. With extension of the air cylinder, the probe element has its upper collecting end placed underneath the flow 12 of clinkers to collect a portion thereof and divert such to a sample flow indicated at 24. Contraction of the air cylinder moves the probe element to one side of flow 12 of clinkers from the kiln, with the clinker flow then flowing uninterruptedly to the operator's transport system where such is carried to a silo or other storage facility.

Sample flow 24 diverted by the sampling probe flows downwardly through the testing unit. During such travel, the particulate material in the sample flow is processed by screening to obtain a flow of sized material within a predetermined size range, with a measured volume of this sized material then being collected and electronically weighed.

Thus, and referring to FIG. 1, unit 14 includes side deflectors 30, 32 receiving material diverted by the probe element, with such being channeled to a throat area 34.

Below this throat area is an inclined screen 36 which separates the particulate material into a retained flow portion 38 of a given size or finer, and a flow portion 40 of oversized material which does not pass through the screen. This material of oversize (the rejected flow of material) continues downwardly in the unit along a passage partially defined by wall 42.

The retained flow portion on falling against a deflector 44 and passing through a throat 46 cascades against another screen 48 which separates the flow portion into a portion of fines which passes through the screen as shown at 50, and a portion 52 of a size within a predetermined range, i.e., larger than the mesh size of screen 48 and smaller than the mesh size of screen 36. The fine material in flow 50 (a rejected flow) joins with the oversize material passing over screen 36 and thence is channeled by deflector 54 and walls defining a passage 56 to fall by gravity into the operator's transport system.

The sized material in flow 52 continues falling by gravity downwardly in the unit through passage 58 into a region controlled by a pivoted gate 60. Gate 60 is actuated by air cylinder 62. With the gate as illustrated, the sized material flows against the gate and past a deflector 64 thence to cascade downwardly in the unit in passage 65 into a weighing region, shown generally at 66. It should be understood that while the drawing illustrates this weighing region to one side of passage 65, by reasons of space limitations on the drawing page, in actuality the weighing unit is directly below the base of passage 65. With gate 60 pivoted to an upright position, the sized material in the flow instead of being diverted by the gate passes downwardly in the unit through a passage 68 with such material then falling onto the operator's transport system.

Considering the weighing region, such includes a sized receptacle 70 with an open top and a bottom 72 hinged at 74. With the bottom in the position shown, such closes off the base of the receptacle. Sized material falling downwardly toward the receptacle fills it and flow is permitted to continue until an overflowed state has been reached. At this time, the flow of sized material stops (as by actuation of gate 60), and a leveler 78 actuated by air cylinder 80 is then caused to move over the top of the receptacle to level off the material to the height of the receptacle.

Shown at 84 is an electronic scale unit on which is supported, as by supports 86, the sized receptacle 70. On command, the weighing unit is actuated to record the weight of the measured volume of material contained within receptacle 70.

Material overflowing from receptacle 70 during the loading time, and material dropping from the base of the receptacle after weighing has occurred through opening up of bottom 72 through actuation of air cylinder 88, falls by gravity down through the testing unit against a deflector 90 which thence channels the material downwardly whence such is collected by the operator's transport system to be further conveyed.

In operating the apparatus described, probe 30 may be shifted to a deflecting position through control of air cylinder 22 for a sufficient time period to assure that the sized material falling downwardly in the testing unit will overflow receptacle 70. Material falling down through the testing unit is separated into a predetermined size range by the screens described, and this is through the action of gravity and by the material cascading downwardly across the respective inclined screens. Gate 60 is actuated to divert material whereby such falls into receptacle 70 and this may be for a timed interval triggered after actuation of the sampling probe, with gate 60 returning to an upright and nondiverting position after a given time period, or alternatively, after the electronic scale determines that the receptacle has sufficient weight to be overflowing. With material flow downwardly toward the top of receptacle 70 stopped, and in proper timed sequence, leveler 78 is actuated to level off the top of the receptacle to produce a measured volume of material. The electronic scale unit then records the weight of such material. This is followed with opening up of bottom 72, whereby material may cascade downwardly from receptacle 70 to clear it. After clearing of the receptacle, the bottom is returned to a closing position and the leveler at this time (or before) may be returned to a position to one side of the top of the receptacle.

This cycle of operation may be repeated periodically as, for instance, on a ten minute or 15 minute basis, depending upon the customer's particular needs.

As an optional feature, product temperature may be incorporated into the testing unit. Such may be done, for instance, by incorporating a temperature responsive probe on the inside of the sized receptacle, which on appropriate demand, will transmit temperature information to suitable controls.

FIG. 2 illustrates in a block diagram a type of control system that may be incorporated with the apparatus disclosed. Referring to the drawing, electronic scale unit 84 is operatively connected to a programmable controller indicated at 94. The programmable controller may control the operating cycles of the electronic scale unit and also supplies information to what is referred to herein as air cylinder control 96 controlling the timing and operation of the various air cylinders in the testing unit regulating product flow, as exemplified by air cylinders 22, 62, 80, and 88. The programmable controller also provides data to control center 98, such as the time of weighing, weights, etc. which may be recorded and also utilized in regulating operating conditions of the kiln such as kiln temperature.

The apparatus and method described can be very valuable to a kiln operator in maintaining proper operating conditions in a kiln, consistency in the type of product produced, and production cost reduction. With testing performed on a regular, periodic basis and with the time of each testing and weight information contained in each testing recorded and utilized in kiln control, the kiln operator has the information to efficiently carry out plant production and control of such things as flow of product from the kiln into the particular silo or storage area desired. Material that flows through the testing unit flows by gravity downwardly therethrough. The testing unit, in a manner of speaking, is self cleaning. Material flowing through the testing unit and at the completion of the testing is suitable channeled through the unit to be returned to the operator's transport system.

While a particular embodiment of the invention has been described, it should be obvious that variations and modifications are possible without departing from the invention.

It is claimed and desired to secure by Letters Patent:

1. A method of controlling the sintering of a particulate product in a kiln, or the like, through monitoring the condition of the product comprising:

regularly and periodically diverting from a moving mass of the product leaving the kiln a flow of material and directing such flow of material into a flow system through which the material passes, treating the flow of material by screening the flow of material in said flow system to produce a flow of sized material in the flow system having a particle size within a predetermined range, collecting in said flow system from the flow of sized material a measured volume of material, weighing the measured volume to obtain a weight-related measurement, electronically recording the weight-related measurement and time of measurement, and controlling sintering conditions in response to the recorded time and weight-related measurements.

2. The method of claim 1, wherein said screening is performed through gravity cascading of the flow of material against a first-inclined screen with separation of a flow portion made up of particles of a size smaller than a given size and subsequently cascading this flow portion against a second-inclined screen with separation from the flow portion of a flow of sized material where the particles have a size larger than another given size.

3. The method of claim 2, wherein screening of the flow of material produces a rejected flow of material made up of particles having a size outside said predetermined range, and wherein the collecting from the flow of sized material of a measured volume is performed by cascading the flow of sized material into a volume measuring receptacle, and after weighing the receptacle is emptied to produce a gravity flow of the material measured, the gravity flow of material measured and rejected flow of material being collected in a common transport system.

4. A method of controlling the sintering of a particulate product in a kiln, or the like, wherein the product leaves the kiln as a gravity flow of product, comprising:

periodically diverting from the gravity flow of product, a sample of material and producing from such sample, a gravity induced flow of sample material, and processing the flow of sample material by screening the flow of sample material to produce a flow of sized sample material having a particle size within a predetermined range, collecting from the flow of sized sample material, a measured volume of sized sample material, weighing the measured volume of sized sample material and electronically recording weight measurement data pertaining to said weighing, and controlling sintering in response to said weight measurement data.

5. The method of claim 4, wherein screening of the sample material is performed by cascading through gravity the flow of sample material against a first-inclined screen with separation of a flow portion of the sample material made up of particles of a given size and finer, and subsequently cascading this flow portion of sample material against a second-inclined screen with separation from the flow portion of a flow of sized sample material.

6. A method of controlling the sintering of a particulate product in a kiln, or the like, through monitoring the condition of the product comprising:

producing from the product in the kiln a flow of material and directing the flow of material into a flow system, processing the flow of material in the flow system to produce a flow of sized material in the flow system having a particle size within a predetermined range, collecting in said flow system from the flow of sized material a measured volume of material, weighing the measured volume of material and electronically recording weight measurement data pertaining to said weighing, and controlling sintering in response to said weight measurement data.

* * * * *